US010151316B2

(12) United States Patent
Camatti et al.

(10) Patent No.: US 10,151,316 B2
(45) Date of Patent: Dec. 11, 2018

(54) MOTOR COMPRESSOR UNIT WITH MAGNETIC BEARINGS

(71) Applicant: Nuovo Pignone Srl, Florence (IT)

(72) Inventors: Massimo Camatti, Florence (IT); Roberto Esposito, Florence (IT); Massimiliano Ortiz Neri, Florence (IT); Manuele Bigi, Florence (IT)

(73) Assignee: Nuovo Pignone Srl, Florence (IT)

( * ) Notice: Subject to any disclaimer, the term of this patent is extended or adjusted under 35 U.S.C. 154(b) by 0 days.

(21) Appl. No.: 15/533,197

(22) PCT Filed: Nov. 26, 2015

(86) PCT No.: PCT/EP2015/077759

§ 371 (c)(1),
(2) Date: Jun. 5, 2017

(87) PCT Pub. No.: WO2016/087303

PCT Pub. Date: Jun. 9, 2016

(65) Prior Publication Data

US 2017/0328369 A1 Nov. 16, 2017

(30) Foreign Application Priority Data

Dec. 5, 2014 (IT) ..... FI2014A0267

(51) Int. Cl.
*F04D 17/12* (2006.01)
*F04D 29/058* (2006.01)
(Continued)

(52) U.S. Cl.
CPC ..... *F04D 17/122* (2013.01); *F04D 25/0686* (2013.01); *F04D 25/0693* (2013.01);
(Continued)

(58) Field of Classification Search
CPC .... F04D 17/00; F04D 17/122; F04D 25/0686; F04D 25/0693; F04D 29/00; F04D 29/058; F04D 29/5806
See application file for complete search history.

(56) References Cited

U.S. PATENT DOCUMENTS 8,330,311 B2 12/2012 Ramsey et al.
2006/0157251 A1* 7/2006 Stinessen ..... F04D 25/0606 166/357

(Continued)

FOREIGN PATENT DOCUMENTS

EP 1 826 887 A2 8/2007
EP 2 093 429 A1 8/2009

(Continued)

OTHER PUBLICATIONS

Italian Search Report and Written Opinion issued in connection with corresponding IT Application No. FI2014A000267 dated Aug. 5, 2015.

(Continued)

*Primary Examiner* — James G Sayre
(74) *Attorney, Agent, or Firm* — GE Global Patent Operation

(57) ABSTRACT

A motor-compressor unit for sub-sea applications, including a pressure casing, and an electric motor housed in a motor compartment formed in the pressure casing and a compressor housed in a compressor compartment formed in the pressure casing. A shaft drivingly connects the electric motor and the compressor. At least one magnetic bearing rotatingly supports the shaft and a control system is provided for controlling the magnetic bearing. The control system is housed in a control system compartment structurally connected to and supported by the pressure casing.

22 Claims, 7 Drawing Sheets

(51) Int. Cl.

| | |
|---|---|
| ***F04D 25/06*** | (2006.01) |
| ***F04D 29/58*** | (2006.01) |
| ***F04D 29/00*** | (2006.01) |
| ***F04D 17/00*** | (2006.01) |

(52) U.S. Cl.
CPC ..... *F04D 29/058* (2013.01); *F04D 29/5806* (2013.01); *F04D 17/00* (2013.01); *F04D 29/00* (2013.01)

(56) References Cited

U.S. PATENT DOCUMENTS

| | | | | |
|---|---|---|---|---|
| 2010/0322785 | A1* | 12/2010 | Buse | F04D 17/12 417/53 |
| 2013/0343932 | A1* | 12/2013 | Stinessen | F04D 25/0686 417/410.1 |
| 2014/0154102 | A1* | 6/2014 | Tecza | F04D 17/12 417/53 |
| 2014/0315425 | A1 | 10/2014 | Maier et al. | |
| 2017/0328369 | A1 | 11/2017 | Camatti et al. | |

FOREIGN PATENT DOCUMENTS

| | | | | |
|---|---|---|---|---|
| WO | 2005/003512 | A1 | 1/2005 | |
| WO | 2007/110275 | A1 | 10/2007 | |
| WO | 2014/168488 | A1 | 10/2014 | |
| WO | WO-2016189397 | A1 * | 12/2016 | E21B 43/128 |

OTHER PUBLICATIONS

International Search Report and Written Opinion issued in connection with corresponding PCT Application No. PCT/EP2015/077759 dated Feb. 24, 2016.

International Preliminary Report on Patentability issued in connection with corresponding PCT Application No. PCT/EP2015/077759 dated Jun. 6, 2017.

Machine translation and a copy of Search Report and Office Action issued in connection with corresponding CN Application No. 201580066270.5 dated Jul. 31, 2018.

* cited by examiner 55
51
61
31
1
3A
37B
43
45
37A
W1
W1
53
37D
37C
47
41
38
59
35
57
33
49
27
W2
23
9
3
5
W2
3B
9
25
13
17
15
11
7A
7
7B
21

MOTOR COMPRESSOR UNIT WITH MAGNETIC BEARINGS

BACKGROUND

The present disclosure relates to motor-compressor units, comprising an electric motor and a compressor driven by the electric motor, housed in a pressure casing. Embodiments disclosed herein specifically relate to motor-compressor units for subsea applications. More specifically, the disclosure relates to improvements to motor-compressor units comprising one or more magnetic bearings supporting the driving shaft, which connects the motor and the compressor.

Motor-compressor units are usually comprised of an outer pressure casing which houses an electric motor and a compressor, connected to one another by a driving shaft. The shaft is rotatingly supported in the pressure casing by a plurality of bearings. In some applications, specifically in subsea applications, the pressure casing comprises a motor compartment, which houses the electric motor, and a compressor compartment, which houses the compressor. Both compartments are sealingly closed to prevent penetration of sea water. Earlier subsea motor-compressor units usually employed oil-lubricated bearings for supporting the driving. Recently, magnetic bearings, or active magnetic bearings have been introduced in this kind of machinery, in order to avoid certain disadvantages derived from the presence of lubricating oil in the pressure casings.

Magnetic bearings are controlled by an electronic control system. The electronic control system must be connected to the magnetic bearings housed in the pressure casing. Specifically in subsea applications, a wire connection with subsea water-tight connectors electrically connect the control system with the interior of the pressure casing. The control system is placed externally of the pressure casing and at a distance therefrom. Usually the motor-compressor unit and the control system are mounted on a skid or baseplate. The housing wherein the control unit is arranged is in turn connected by means of data and power cables with electric and electronic devices place above the sea level.

These known arrangements are expensive and cumbersome. The use of a relatively large number of subsea wire connectors renders this known systems prone to failure due to water leakages inside the motor-compressor casing and/or the separate housing wherein the electronic components of the control system are arranged.

Improvements relating to the arrangement of the control system of the magnetic bearings in a motor-compressor unit would thus be desirable.

SUMMARY OF THE INVENTION

According to an embodiment, a motor-compressor unit for sub-sea applications, comprises a pressure casing, an electric motor housed in a motor compartment formed in the pressure casing and a compressor housed in a compressor compartment formed in the pressure casing. The motor-compressor unit can further comprise a shaft drivingly connecting the electric motor and the compressor. The shaft can be rotatingly supported by at least one magnetic bearing, e.g. an active magnetic bearing. According to some embodiments, two or more magnetic bearings are provided. One or more magnetic bearing can be radial bearings and/or one or more magnetic bearings can be axial bearings. According to embodiments of the subject matter disclosed herein a control system for controlling the magnetic bearing(s) is housed in a control system compartment structurally connected to and supported by the pressure casing.

According to some embodiments the control system compartment is integrated in or within the pressure casing of the motor-compressor unit.

According to some embodiments, the control system is electrically connected to the magnetic bearing(s) by means of wirings, which is one embodiment is entirely housed in the pressure casing.

Embodiments of the subject matter disclosed herein provide for a pressure casing comprised of a main casing portion and at least an auxiliary casing portion sealingly connected to one another to form at least a part of the pressure casing. The control system compartment can be arranged in the auxiliary casing portion. The main casing portion can house at least one of the motor compartment and the compressor compartment and in one embodiment both the motor compartment and the compressor compartment.

In some embodiments, a partition wall can be arranged between the auxiliary casing portion and the main casing portion. Electric couplings extend through the partition wall. A control system compartment can be formed in the auxiliary casing portion and can be separated by the motor compartment and/or the compressor compartment by the partition wall. The partition wall can be sealingly coupled to the auxiliary casing portion. The control system compartment is thus fluidly isolated from the remaining compartments of the motor-compressor unit. Potentially dangerous or polluting agents, such as particulate or droplets in the process or cooling gas of the motor-compressor unit are thus prevented from contacting the electronic components and instrumentalities of the magnetic bearing control system.

According to a further aspect, disclosed herein is a method of connecting a control system to magnetic bearings in a motor-compressor unit, comprising the following steps: providing a pressure casing having at least a main casing portion and an auxiliary casing portion; mounting at least one magnetic bearing in the main casing portion; arranging the control system in the auxiliary casing portion; electrically connecting the control system and the magnetic bearing to one another; sealingly connecting the auxiliary casing portion and the main casing portion to one another.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In embodiments disclosed herein a rotor of the motor-compressor unit is supported by a plurality of radial bearings and by an axial bearing. Both the axial as well as the radial bearings are magnetic bearings, in particular active magnetic bearings. In other embodiments, not shown, mixed configurations can be used. For instance, radial magnetic bearings can be combined with at least one axial hydrodynamic bearing. Or else, an active magnetic axial bearing can be combined with radial hydrodynamic bearings.

Figure 1:
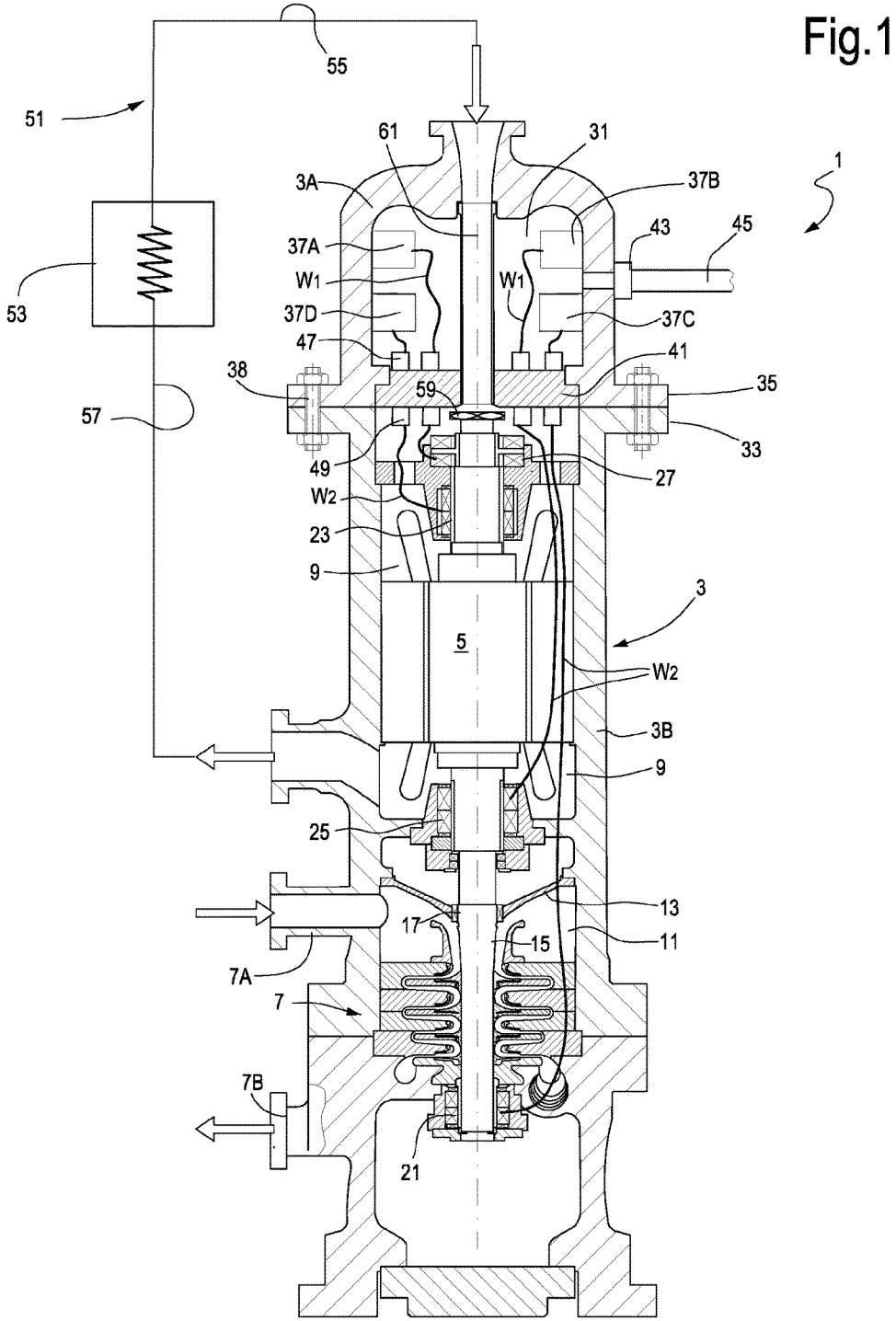
FIG. 1 illustrates a schematic sectional view of a motor-compressor unit according to an embodiment.
Figure 2:
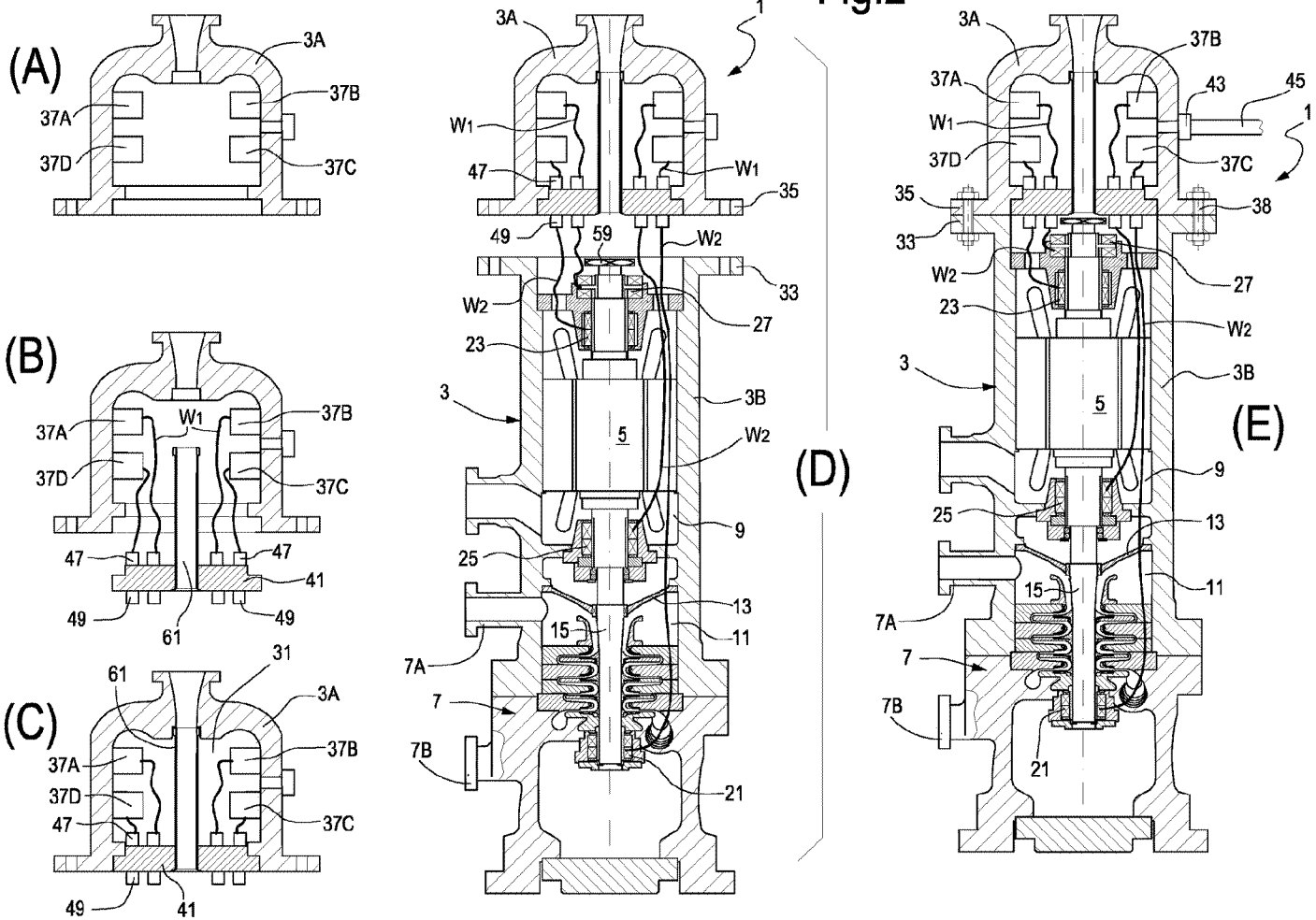
FIG. 2 illustrates steps of an assembling procedure of the a motor-compressor unit illustrated in FIG. 1.

Referring now to FIGS. 1 and 2, according to embodiments disclosed herein, a motor-compressor unit 1 comprises a pressure casing 3 housing an electric motor 5 and a compressor 7. The electric motor 5 can be housed in a motor compartment 9 formed within the pressure casing 3. The compressor 7 can be housed in a compressor compartment 11 formed within the pressure casing 3. Reference numbers 7A and 7B designate the compressor inlet and compressor outlet, respectively.

The motor compartment 9 and the compressor compartment 11 can be separated from one another by a separation wall 13. A shaft 15 drivingly connects the electric motor 5 and the compressor 7. In the schematic of FIG. 1 the motor-compressor unit 1 is arranged with the shaft 15 oriented vertically and the compressor 7 placed underneath the motor 5. In other embodiments a different configuration or orientation of the motor-compressor unit 1 can be foreseen.

The shaft 15 extends through the separation wall 13. In some embodiments sealing arrangements 17 can be provided around the shaft 15 at the separation wall 13, to prevent or reduce gas leakages from one compartment to the other. Thus, processed gas processed by the compressor 7 is prevented from penetrating into the motor compartment 9.

The shaft 15 is rotatingly supported in the pressure casing 3 by means of a plurality of bearings. In some embodiments a first radial bearing 21 can be arranged at a first end of shaft 15. A second radial bearing 23 can be provided at a second end of the shaft 15. A third, intermediate radial bearing 25 can be provided in an intermediate position between the motor 5 and the compressor 7. In some embodiments one or more axial bearings can further be provided. In the exemplary embodiment of FIG. 1 an axial bearing 27 is provided at the upper end of shaft 15, adjacent the second radial bearing 23. A further or alternative axial bearing can be provided in an intermediate position between the motor 5 and compressor 7 and/or below the compressor 7.

The bearings 21, 23, 25 and 27 are represented only schematically in FIG. 1. One, some or all said bearings can be magnetic bearings and more specifically active magnetic bearings. Active magnetic bearings are known to those skilled in the art and will not be described in greater detail herein.

Magnetic bearings require an electronic control system, which provides power and control signals to the magnetic bearings. According to embodiments disclosed herein the control system is housed in a control system compartment 31 which can be structurally connected to pressure casing 3, i.e. supported by pressure casing 3.

In some embodiments, as exemplarily shown in FIG. 1, the control system compartment 31 is formed inside an auxiliary casing portion 3A, which forms part of the pressure casing 3. The auxiliary casing portion 3A can be mounted on a main casing portion 3B. In FIG. 1 the motor compartment 9 and the compressor compartment 11 are arranged in the main casing portion 3B. The main casing portion 3B can in turn be divided into two or more sub-portions, assembled to form the main casing portion 3B. The auxiliary casing portion 3A and the main casing portion 3B can be sealingly coupled to one another.

According to some embodiments, the main casing portion 3B can be provided with a first mounting flange 33. The auxiliary casing portion 3A can be provided with a second mounting flange 35. The main casing portion 3B and the auxiliary casing portion 3A can be sealingly coupled to one another at flanges 33 and 35, for example by means of nut-bolt arrangements 38.

The control system compartment 31 can house one or more electric and electronic components. Four such components are schematically shown at 37A, 37B, 37C and 37D in FIG. 1. In some embodiments each component 37A-37D is configured and arranged to control and power one of the four magnetic bearings 21, 23, 25 and 27 which rotatingly support shaft 15. A different number of magnetic bearings and/or a different number of components 37A-37B can be foreseen, e.g. depending upon design choices and/or requirements of the motor-compressor unit.

Since the electric and electronic components can be affected by the processed gas, the control system compartment 31 is more particularly filled with an inert gas, for instance nitrogen. In the context of the present description and attached claims, the term inert gas also encompasses noble gases, such as helium, for instance, as well as gas mixtures, for instances mixtures mainly composed of nitrogen or helium.

Moreover, in order to avoid damages to the electric and electronic components, the inert gas pressure inside the control system compartment 31 can be maintained below the pressure inside the pressure casing 3. In one embodiment the inert gas pressure is around 1 bar.

In the embodiment of FIG. 1, the control system compartment 31 is arranged above the electric motor 5, i.e. the motor compartment 9 is located between the control system compartment 31 and the compressor compartment 11. In other embodiments, not shown, the control system compartment 31 could be placed on the opposite side, so that the compressor compartment 11 would then be located between the motor compartment 9 and the control system compartment 31.

In some embodiments, the control system compartment 31 is sealingly isolated from the interior of the motor compartment 9 and/or the compressor compartment 11. In some embodiments, a partition wall 41 is provided between the motor compartment 9 and the control system compartment 31. If the latter is mounted on the opposite side, i.e. adjacent the compressor compartment 11, the partition wall 41 would then be located between the control system compartment 31 and the compressor compartment 11.

In some embodiments, the partition wall 41 can be mounted on the auxiliary casing portion 3A, for instance at the second mounting flange 35 and can be surrounded thereby. The partition wall 41 can be sealingly connected to the auxiliary casing portion 3A, so that the control system compartment 41 is protected against penetration of pollutants, moisture or other elements which might damage the electronic circuitry arranged in the control system compartment 31.

In some embodiments a connector flange 43 can be provided on the auxiliary casing portion 3A for the passage of power and/or signal cables 45 which connect the motor-compressor unit 1 to an external source of electric power and possibly to external control devices.

Electric connection between each electronic component 37A-37D and the respective magnetic bearings 21-27 can be obtained by means of pairs of electric connectors 47, 49 arranged on a first surface and on a second surface of the partition wall 41. In FIG. 1 the first surface of the partition wall 41, facing the interior of the control system compartment 31, is provided with first electric connectors 47. The opposite, second surface of the partition wall 41, facing the interior of the motor compartment 9, is provided with second electric connectors 49.

As schematically illustrated in FIG. 1, first wirings W1 connect the components 37A-37B to respective first connectors 47, and second wirings W2 connect the second electric connector 49 to the respective magnetic bearings 21-27. In the drawings the wirings W1, W2 are shown only schematically. Suitable passages, channels or protective sheaths can in practice be used to protect and contain the wiring in order to prevent damages during assembling of the components of the motor-compressor unit and/or during operation thereof, e.g. due to impacts with rotating parts of the motor-compressor unit.

With the arrangement described so far, the connectors between the electric components 37A-37D and the magnetic bearings 21-27 are entirely housed in inside the pressure casing 3. If the motor-compressor unit is used for subsea applications, the connectors are thus housed in a protected environment, instead of being immersed in sea water.

In some embodiments, for instance in subsea applications, the motor-compressor unit 1 can be provided with a cooling system, aimed at cooling the electric motor 5 during operation of the motor-compressor unit 1. In some embodiments a cooling circuit 51 can be provided, comprising a heat exchanger 53, as well as inlet duct 55 and outlet duct 57 fluidly connecting the heat exchanger 53 with the interior of the motor compartment 9. The ducts 55, 57, the heat exchanger 53 and the motor compartment 9 form a closed circuit wherein a cooling medium, such as a cooling gas circulates. In some embodiments, a cooling medium fan 59 can be provided for circulating the cooling gas in the cooling circuit 51. In some embodiments the fan 59 can be mounted on shaft 15, so that the same electric motor 5 rotates both the compressor 7 and the fan 59.

In some embodiments the cooling medium can be the same gas which is processed by the compressor 7. In a known manner, processed gas can be derived from the compressor 7, cleaned and filtered, if necessary, to remove particulate, or other contaminants, such as droplets of liquid hydrocarbons or the like from the gas. The thus cleaned gas is introduced into the cooling circuit, filling also the motor compartment 9. The partition wall 13 and the sealing arrangements 17 reduce or prevent cooling gas leakages from the motor compartment 9 towards the compressor compartment 7 and/or vice versa. Usually, the pressure in the motor compartment 9 is higher than the pressure in the first stage of the compressor 7, such that in case of leakage, clean gas will leak from the motor compartment 9 towards the compressor compartment 11, but contaminated gas will be prevented from leaking towards the motor compartment 9.

According to some embodiments, the inlet duct 55 can be fluidly coupled to a cooling medium duct 61, which extends through the control system compartment 31, ending at or near the fan 59. The opposite end of the cooling medium duct 61 ends near or at a cooling medium inlet flange arranged on the pressure casing 3. In this way, cooling gas circulates through the control system compartment 31, without contaminating the compartment, but contributing to removal of heat which can be generated by the electronic components 37A-37D housed in the control system compartment 31. The heat removed by the cooling gas circulating in the cooling medium duct 61 is discharged in the environment through the heat exchanger 53, together with heat removed by cooling gas from the electric motor 5. The cooling medium duct 61 can be finned to increase heat exchange. Mounting of the electronic and electronic components 37A-37B and wiring of the components and the magnetic bearings is facilitated by the above described configuration.

FIG. 2 schematically illustrates a possible sequence of steps of a mounting procedure. In FIG. 2A the step of mounting the electric components 37A-37D in the auxiliary casing portion 3A is shown. During this step, the auxiliary casing portion 3A is still separate from the main casing portion 3B.

In FIG. 2B the wiring W1 connecting the electric components 37A-37D to the first electric connectors 47 carried by the partition wall 41 has been completed. The partition wall 41 is provided with second electric connectors 49 on the second face thereof. In FIG. 2C the partition wall 41 is mounted on the auxiliary casing portion 3A, for example by means of screws or bolts, not shown in detail.

In a separate step, wirings W2 of the magnetic bearings 21-27 are installed inside the main casing portion 3B. In FIG. 2D the electric connection between wirings W2 and the second connector 49 is shown.

Once the wirings W2 have been connected to the second electric connectors 49, the two casing portions 3A and 3B can be assembled and sealingly connected to one another as shown in FIG. 2E.

Figure 3:
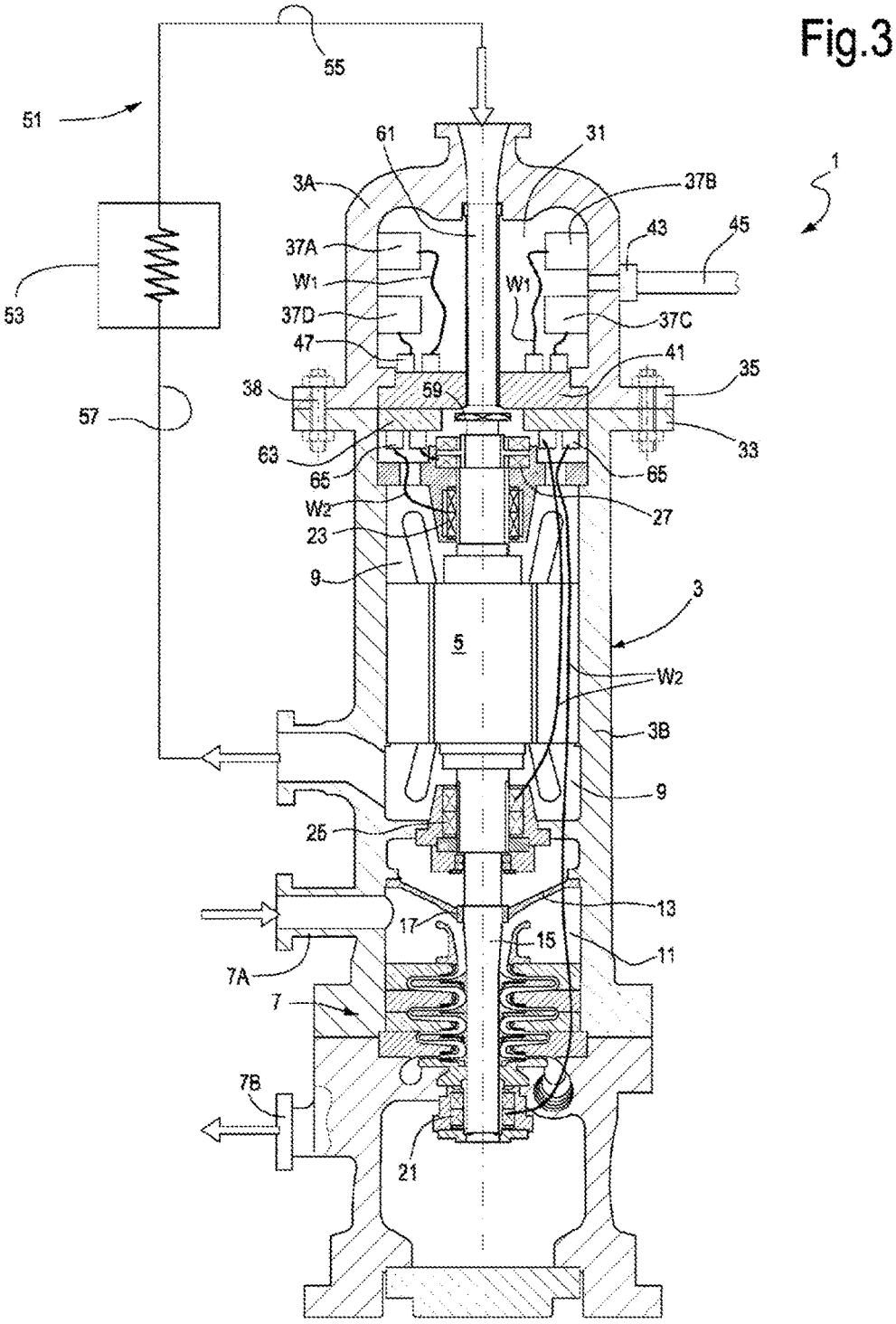
FIG. 3 illustrates a schematic sectional view of a further embodiment of a motor-compressor unit according to an embodiment of the present invention.

In FIG. 3 a further embodiment of a motor-compressor 1 according to the present disclosure is shown. The same reference numbers designate the same or corresponding components, parts ad elements as already disclosed in connection with FIGS. 1 and 2. These components will not be described again.

Figure 4:
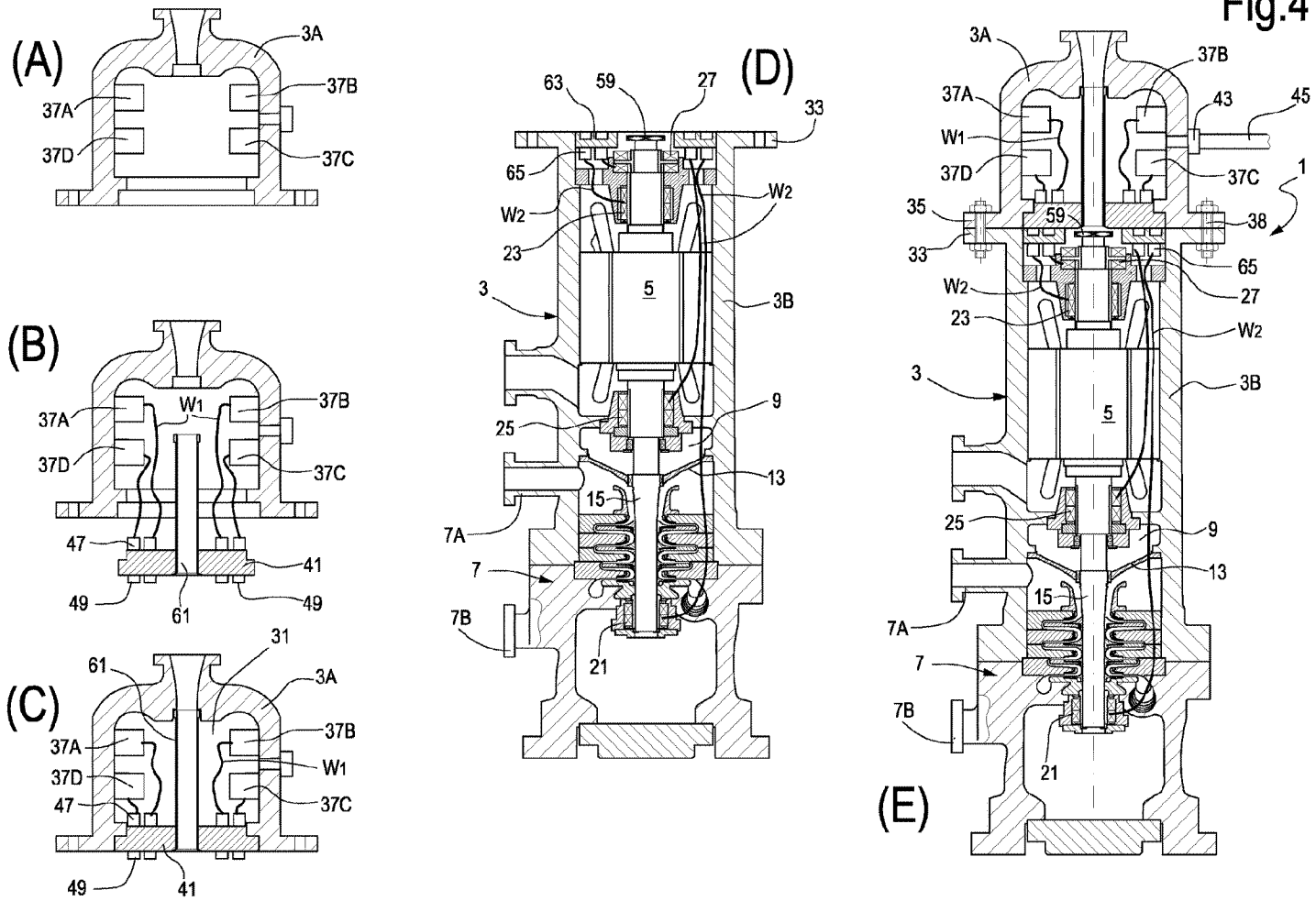
FIG. 4 illustrates steps of an assembling procedure for assembling the motor-compressor unit of FIG. 3.

As best shown in FIG. 4, the difference between the embodiment of FIGS. 1, 2 and the embodiment of FIGS. 3, 4 consists mainly in that in FIGS. 3 and 4 the main casing portion 3B is provided with an inner flange 63 extending radially inwardly in correspondence of the first mounting flange 33. The inner flange 63 is provided with third electric connectors 65, which are connected with wirings W2 of the magnetic bearing 21-27.

The electric connectors 65 can be electrically coupled to the second electric connectors 49 arranged on the second surface of the partition wall 41. The first electric connectors 47 placed on the first surface of the partition wall 41 are electrically coupled with the electric components 37A-37D through wirings W1 as described above.

In FIG. 4 the steps of assembling the wirings and electric connection between the electric components 37A-37D and the magnetic bearings 21-27 is illustrated.

In FIG. 4A the electric components 37A-37D have been mounted in the control system compartment 31. In FIG. 4B wirings W1 connect the components 37A-37D to the first electric connectors 47 and thus to the second electric connectors 49. In FIG. 4D the step of connecting the wirings W2 and the third electric connectors 65 is shown. Finally, in FIG. 4E the auxiliary casing portion 3A and the main casing portion 3B are assembled to one another. During this step the second electric connectors 49 establish an electric contact with the corresponding third electric connectors 65 provided on the inner flange 63 of the main casing portion 3B.

Figure 5:
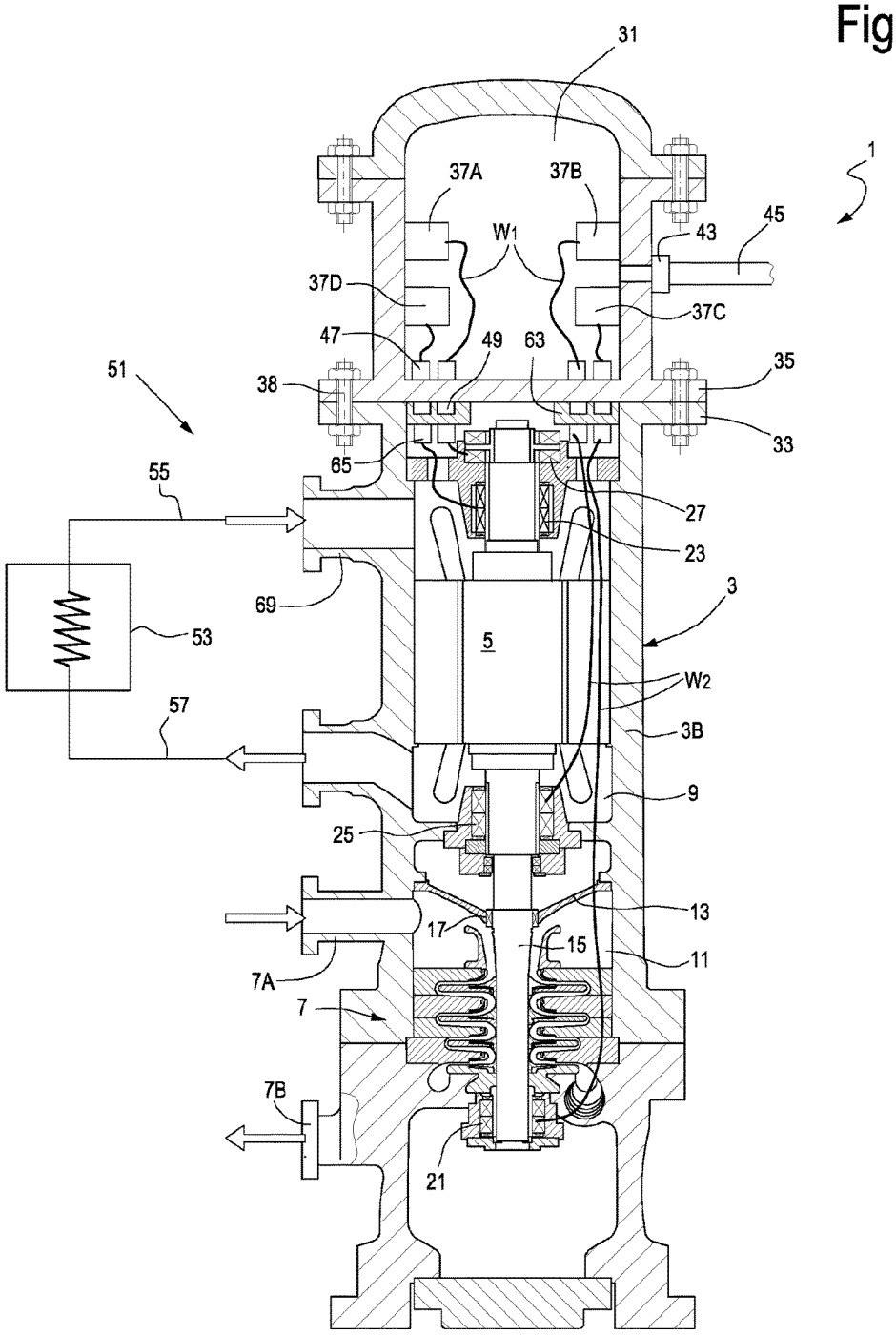
FIG. 5 illustrates a schematic sectional view of a further embodiment of a motor-compressor unit.

In FIG. 5 a schematic sectional view of a further embodiment of a motor-compressor unit 1 according to the present disclosure is shown. The same or corresponding parts, components or elements as disclosed above in connection with FIGS. 1 through 4 are labelled with the same reference numbers and are not described again. Differently from the embodiments of FIGS. 1 through 4, in the embodiment of FIG. 5 the cooling circuit 51 does not extend through the control system compartment 31. The duct 55 is connected to an auxiliary flange 69 provided on the main casing portion 3B.

Figure 6:
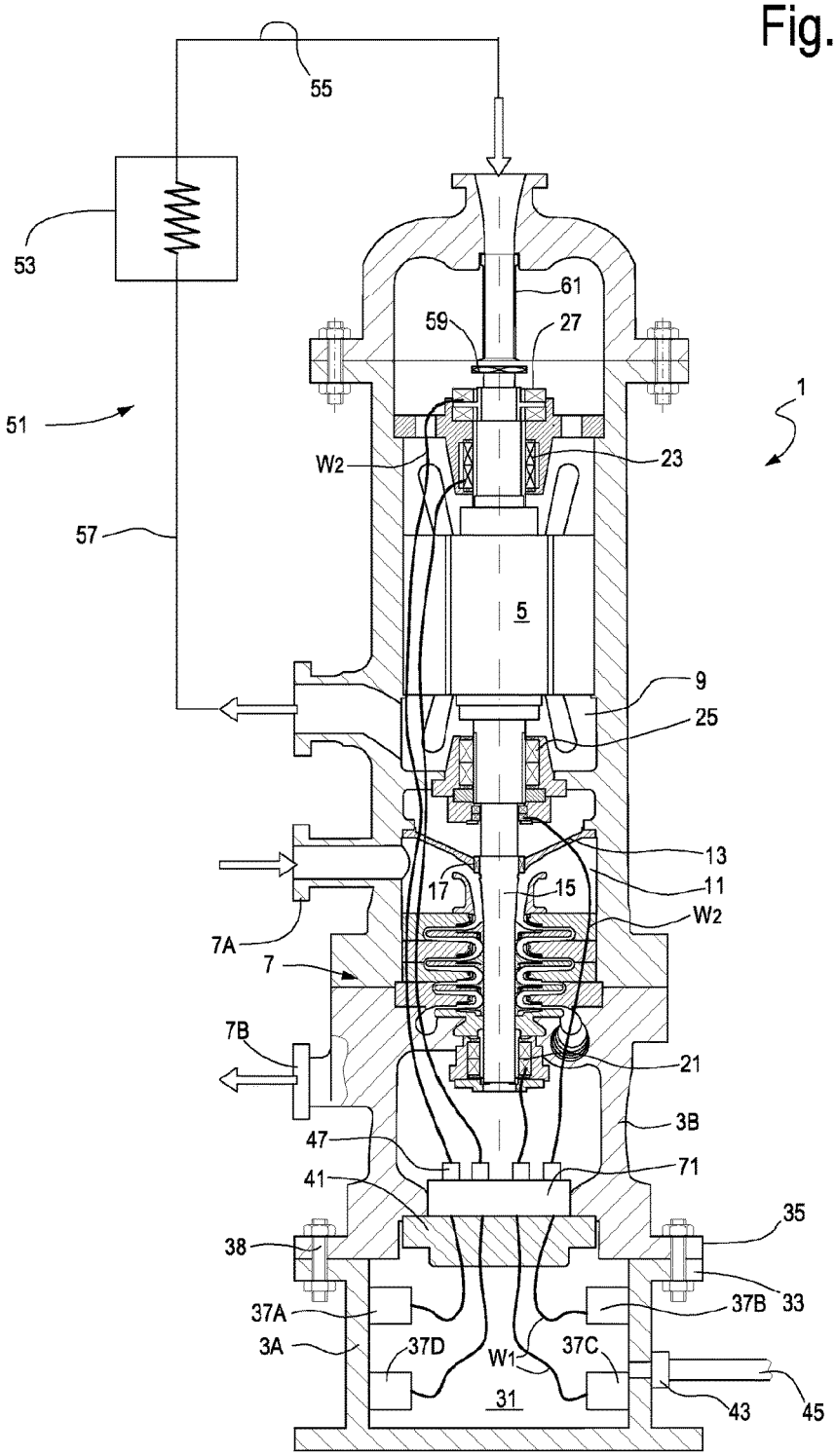
FIG. 6 illustrates a further embodiment of a motor-compressor unit according to an embodiment of the present invention.

FIG. 6 illustrates a sectional view of the lower portion of a further embodiment of a motor-compressor unit according to the present disclosure. The same reference numbers are used to designate the same or equivalent part, components or elements as already disclosed in connection with the previous FIGS. 1 to 5.

In the embodiment of FIG. 6 the control system compartment 31 is formed by an auxiliary casing portion 3A which is attached to the main casing portion 3B on the side of the compressor 7, i.e. adjacent the compressor compartment 11.

In the exemplary embodiment of FIG. 6 mounting flanges 33 and 35 are again provided on the main casing portions 3B and the auxiliary casing portion 3A, respectively. A partition wall, again labelled 41, is provided to sealingly isolate the control system compartment 31 from the compressor compartment 11. A connector arrangement 71 is located on the first surface, facing the compressor compartment 11, of partition wall 41. Wirings W1 connect the electric components 37A-37D housed in the control system compartment 31 to the connector arrangement 71. Therefrom wirings can extend, connecting the connector arrangement 71 to the magnetic bearing 21-27 provided in the pressure casing 3.

Figure 7:
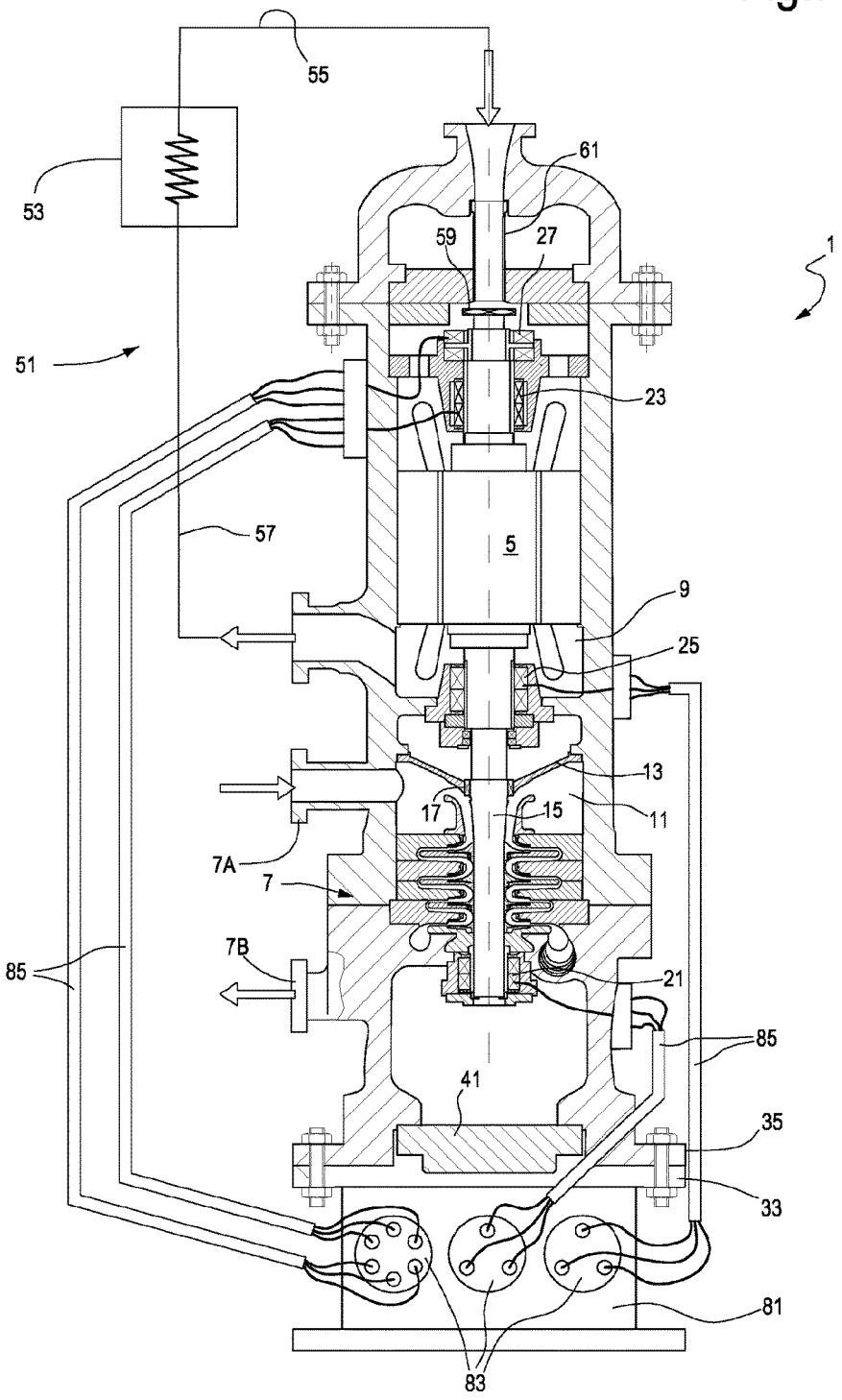
FIG. 7 illustrates a yet further embodiment of a motor-compressor unit.

In FIG. 7 a yet further embodiment of a motor-compressor unit 1 is shown. The same reference numbers designate the same parts or components as described above. In this embodiment the control system compartment is formed inside a cartridge 81, which is provided with external connectors 83, wherefrom wirings 85 depart and penetrate through connectors provided on the pressure casing 3 for connection with the magnetic bearing arranged in the pressure casing 3.

In an embodiment of FIG. 7 sealingly housing the connectors inside the pressure casing 3 may be lost, but supporting the compressor compartment 81 directly on the pressure casing 3, providing a structural connection between the two elements is maintained.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A motor-compressor unit for subsea applications, the motor-compressor unit comprising:

a pressure casing having a main casing portion and an auxiliary casing portion sealingly connected to one another and having a partition wall therebetween;

an electric motor housed in a motor compartment formed in the pressure casing;

a compressor housed in a compressor compartment formed in the pressure casing;

a shaft drivingly connecting the electric motor and the compressor;

at least one magnetic bearing rotatingly supporting the shaft; and a control system for controlling the magnetic bearing housed in a control system compartment arranged within the auxiliary casing portion;

wherein the partition wall comprises first electric connectors on a first surface of the partition wall and second electric connectors on a second surface of the partition wall, each of the first electric connectors being electrically coupled to a respective one of the second electric connectors.

2. The motor-compressor unit of claim 1, wherein the control system compartment is integrated within the pressure casing.

3. The motor-compressor unit of claim 1, wherein the motor compartment is arranged between the control system compartment and the compressor compartment.

4. The motor-compressor unit of claim 1, wherein the compressor compartment is arranged between the motor compartment and the control system compartment.

5. The motor-compressor unit claim 1, wherein wirings electrically connecting the control system and the at least one magnetic bearing are entirely housed within the pressure casing.

6. The motor-compressor unit of claim 1, wherein the main casing portion houses at least one of the motor compartment and the compressor compartment.

7. The motor-compressor unit of claim 1, wherein the auxiliary casing portion comprises a connector flange, where through electric power and/or electric signal cables enter the control system compartment.

8. The motor-compressor unit of claim 1, wherein the main casing portion has a first mounting flange and the auxiliary casing portion has a second mounting flange, the auxiliary casing portion and the main casing portion being connected to one another at the first mounting flange and second mounting flange.

9. The motor-compressor unit of claim 1, wherein the control system compartment is filled with inert gas.

10. The motor-compressor unit of claim 9, wherein an inert gas pressure inside the control system compartment is below a pressure inside the pressure casing.

11. The motor-compressor unit of claim 1, wherein the first surface faces the auxiliary casing portion and the second surface faces the main casing portion.

12. The motor-compressor unit of claim 1, wherein the main casing portion comprises an inner flange provided with electric connectors configured and arranged for electrically connecting wirings of the magnetic bearing to the second electric connectors of the partition wall.

13. The motor-compressor unit of claim 1, wherein the partition wall is connected to a cooling medium duct extending therethrough.

14. The motor-compressor unit of claim 13, wherein the cooling medium duct is fluidly coupled to a cooling medium inlet flange arranged on the pressure casing.

15. The motor-compressor unit of claim 13, wherein the cooling medium duct is fluidly coupled to the motor compartment, and wherein a cooling medium fan is arranged in the motor compartment.

16. The motor-compressor unit of claim 15, wherein the cooling medium fan is mounted on the shaft.

17. A method of connecting a control system to at least one magnetic bearing in a motor-compressor unit, the method comprising:

arranging a pressure casing having at least a main casing portion and an auxiliary casing portion and a partition wall therebetween;

mounting at least one magnetic bearing in the main casing portion;

arranging the control system in the auxiliary casing portion;

electrically connecting the control system and the at least one magnetic bearing to one another;

sealingly connecting the auxiliary casing portion and the main casing portion to one another; and arranging first electric connectors on a first face of the partition wall, and second electric connectors on a second surface of the partition wall; each of the first electric connectors being electrically coupled to a respective one of the second electric connectors.

18. The method of claim 17, further comprising mounting a compressor in a compressor compartment formed in the main casing portion of the pressure casing and an electric motor in an electric motor compartment formed in the main casing portion, the compressor and the electric motor being drivingly connected by a shaft supported by at least the one magnetic bearing.

19. The method of claim 17, further comprising arranging the partition wall such that the control system compartment formed in the auxiliary casing portion is separated from an inner volume of the main casing portion.

20. The method of claim 19, wherein the electrically connecting the control system and the magnetic bearing to one another further comprises:

electrically connecting the control system to the first electric connectors;

electrically connecting the magnetic bearing to the second electric connectors; and arranging the partition wall between the control system compartment and the inner volume of the main casing portion before sealingly connecting the auxiliary casing portion and the main casing portion to one another, the first surface of the partition wall being oriented towards the control system compartment and the second face being oriented towards the interior of the main casing portion.

21. The method of claim 20, wherein connecting the magnetic bearings to the second electric connectors comprises:

arranging an inner flange in the main casing portion;

arranging electric connections across the inner flange;

electrically connecting the magnetic bearings to one side of the inner flange; and electrically connecting the second electric connectors of the partition wall to the other side of the inner flange.

22. A motor-compressor unit comprising:

a pressure casing;

an electric motor housed in a motor compartment formed in the pressure casing;

a compressor housed in a compressor compartment formed in the pressure casing;

a shaft drivingly connecting the electric motor and the compressor;

at least one magnetic bearing rotatingly supporting the shaft; and a control system for controlling the magnetic bearing;

wherein the control system is housed in a control system compartment structurally connected to and supported by the pressure casing, wherein the pressure casing comprises a main casing portion and at least an auxiliary casing portion sealingly connected to one another to form at least a part of the pressure casing, and wherein the control system compartment is arranged in the auxiliary casing portion, a partition wall between the auxiliary casing portion and the main casing portion to sealingly isolate the control system compartment formed in the auxiliary casing portion from an inner volume of the main casing portion; and wherein the partition wall comprises first electric connectors on a first surface of the partition wall and second electric connectors on a second surface of the partition wall, the first surface facing the auxiliary casing portion and the second face facing the main casing portion, each of the first electric connectors being electrically coupled to a respective one of the second electric connectors.

* * * * *